US006914570B2

(12) United States Patent
Asrani et al.

(10) Patent No.: US 6,914,570 B2
(45) Date of Patent: Jul. 5, 2005

(54) ANTENNA SYSTEM FOR A COMMUNICATION DEVICE

(75) Inventors: Vijay L. Asrani, Boynton Beach, FL (US); Paul Morningstar, North Lauderdale, FL (US)

(73) Assignee: Motorola, Inc., Schaumburg, IL (US)

( * ) Notice: Subject to any disclaimer, the term of this patent is extended or adjusted under 35 U.S.C. 154(b) by 50 days.

(21) Appl. No.: 10/705,280

(22) Filed: Nov. 10, 2003

(65) Prior Publication Data

US 2005/0099343 A1 May 12, 2005

(51) Int. Cl.[7] ..... H01Q 1/24
(52) U.S. Cl. ..... 343/702; 379/433; 455/89; 455/90
(58) Field of Search ..... 343/702, 880, 343/881, 882; 379/433, 434; 455/89, 90, 575

(56) References Cited

U.S. PATENT DOCUMENTS 5,014,346 A * 5/1991 Phillips et al. ..... 455/575.7
5,508,709 A * 4/1996 Krenz et al. ..... 343/702
5,542,106 A 7/1996 Krenz et al.
5,561,436 A * 10/1996 Phillips ..... 343/702
5,561,437 A 10/1996 Phillips et al.
5,606,730 A * 2/1997 Rush et al. ..... 455/575.3
5,761,300 A * 6/1998 Domoleczny ..... 379/433.13
6,256,481 B1 * 7/2001 Jeong et al. ..... 455/575.3

* cited by examiner

*Primary Examiner*—Tho Phan
(74) *Attorney, Agent, or Firm*—Randi L. Karpinia

(57) ABSTRACT

An antenna system (200,400,500,600) for use within a communication device (100) is disclosed. The communication device (100) including a signal source (260,425,635), a main housing (105) and a movable flip housing (110) moveably coupled to the main housing (105) through a hinge assembly (125). The hinge assembly (125) being comprised of a hinge shaft, a first knuckle (805) coupled to one side of the hinge shaft, and a second knuckle (810) coupled to an opposing side of the hinge shaft. The antenna system (200,400,500,600) includes at least one of the knuckles of the hinge assembly (125).

36 Claims, 7 Drawing Sheets

| SCENARIO | ANT 1 | ANT 2 | ANT 3 | ANT 4 | DESCRIPTION |
|---|---|---|---|---|---|
| 1 | + | − | − | − | ANT1 USED AS MAIN ANTENNA, ANT2,3,& 4 AS GROUND RESONATORS |
| 2 | − | + | − | − | ANT 1 USED AS MAIN ANTENNA, ANT 2,3 AS GROUND RESONATORS |
| 3 | + | + | − | − | DIVERSITY WITH ANT1 & ANT2 AS MAIN ANTENNA, ANT3 & 4 AS GROUND RESONATORS |
| 4 | − | − | + | − | GROUND RESONATOR DIVERSITY WITH ANT1 & ANT2 & ANT4. ANT3 AS MAIN ANTENNA |
| 5 | + | − | + | − | DUAL POLARITY DIVERSITY |
| 6 | − | + | + | − | DUAL POLARITY DIVERSITY |
| 7 | + | + | + | − | THREE ELEMENT DIVERSITY WITH ON GROUND RESONATOR, ANT3 |
| 8 | − | − | − | + | SAME AS #7, POLARITY REVERSAL |
| 9 | + | − | − | + | SAME AS #6, POLARITY REVERSAL |
| 10 | − | + | − | + | SAME AS #5, POLARITY REVERSAL |
| 11 | + | + | − | + | SAME AS #4, POLARITY REVERSAL |
| 12 | − | − | + | + | SAME AS #3, POLARITY REVERSAL |
| 13 | + | − | + | + | SAME AS #2, POLARITY REVERSAL |
| 14 | − | + | + | + | SAME AS #1, POLARITY REVERSAL |
| 15 | + | + | + | + | MAIN ANTENA AND ALL AUX ELEMENTS DRIVEN BY THE UNGROUNDED SIG.SOURCE TERMINAL |

*FIG. 3*

ANTENNA SYSTEM FOR A COMMUNICATION DEVICE

BACKGROUND OF THE INVENTION

1.Field of the Invention

The present invention is related to a communication-device, and more particularly to an antenna system for a communication device.

2.Description of the Related Art

Communication devices, such as radiotelephones, are being driven by the marketplace and technology towards smaller, more compact sizes and form factors. Consumer and user demand has continued to push a dramatic reduction in the size of such communication devices. The reduction in size provides additional challenges to the device designers to achieve adequate antenna electrical performance.

To create a more compact package, many communication devices in use today have incorporated as part of the overall communication device a flip assembly housing (also known as a clamshell assembly). A flip assembly housing typically consists of two or more housing portions that can each contain one or more printed circuit boards (PCBs) with electronic components, audio devices, cameras, visual displays, and the like, as well as wiring to connect the electronic components together. In some communication devices, one housing portion is a hinged cover that closes to make the communication device more compact and to protect a keypad or other user interface located on a second housing portion from inadvertent entries. Typically, one housing rotates relative to the other housing in a plane perpendicular to the plane of the other housing. As an example, a communication device such as a radiotelephone can comprise two planar elements coupled by a hinge. When the radiotelephone is not in use, the two planar elements are closed and lie in parallel. When the radiotelephone is in use, the two planar elements are opened in relation to each other, exposing such elements as a key pad, display, microphone and/or speaker.

Each communication device includes an antenna coupled to a transceiver to perform the receiving and transmitting functions required of the communication device. Typically, the antenna is not the only structure that radiates the energy within a communication device. For example, a portion of the energy is radiated from the grounding structure (for example, a PCB ground) connected to the source of energy (for example, a generator). When the physical length of the grounding structure is not a multiple of the half (½) wavelength of the frequency of the radiated energy, the efficiency of the radiating structure can diminish. Testing has shown, for example, a degradation of performance of small clamshell phones at frequencies further away from half (½) wavelength compared to larger phones.

Further, it has been observed that the presence of a user's body, for example, a finger holding a radiotelephone, can cause a degradation of performance. The antenna is detuned by the finger touch grip and degrades the performance.

BRIEF DESCRIPTION OF THE DRAWINGS

The accompanying figures, where like reference numerals refer to identical or functionally similar elements throughout the separate views and which together with the detailed description below, are incorporated in and form part of the specification, serve to further illustrate various embodiments and to explain various principles and advantages all in accordance with the present invention.

FIG. 3 is a table illustrating examples of the various alternative combinations of antennas.

DETAILED DESCRIPTION OF THE PREFERRED EMBODIMENT(S)

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

The concept of the present invention can be advantageously used on any electronic product requiring the transceiving of radio frequency (RF) signals. The communication portion can be constructed in accordance with an analog communication standard or a digital communication standard. The communication portion generally includes a radio frequency (RF) transmitter, a RF receiver, a controller, an antenna, a battery, a duplex filter, a frequency synthesizer, a signal processor, and a user interface including at least one of a keypad, display, control switches, and a microphone. The electronic product can also include a messaging receiver. The electronics incorporated into a cellular phone, a two-way radio, a selective radio transceiver, or the like are well known in the art, and can be incorporated into the communication device of the present invention.

Figure 1:
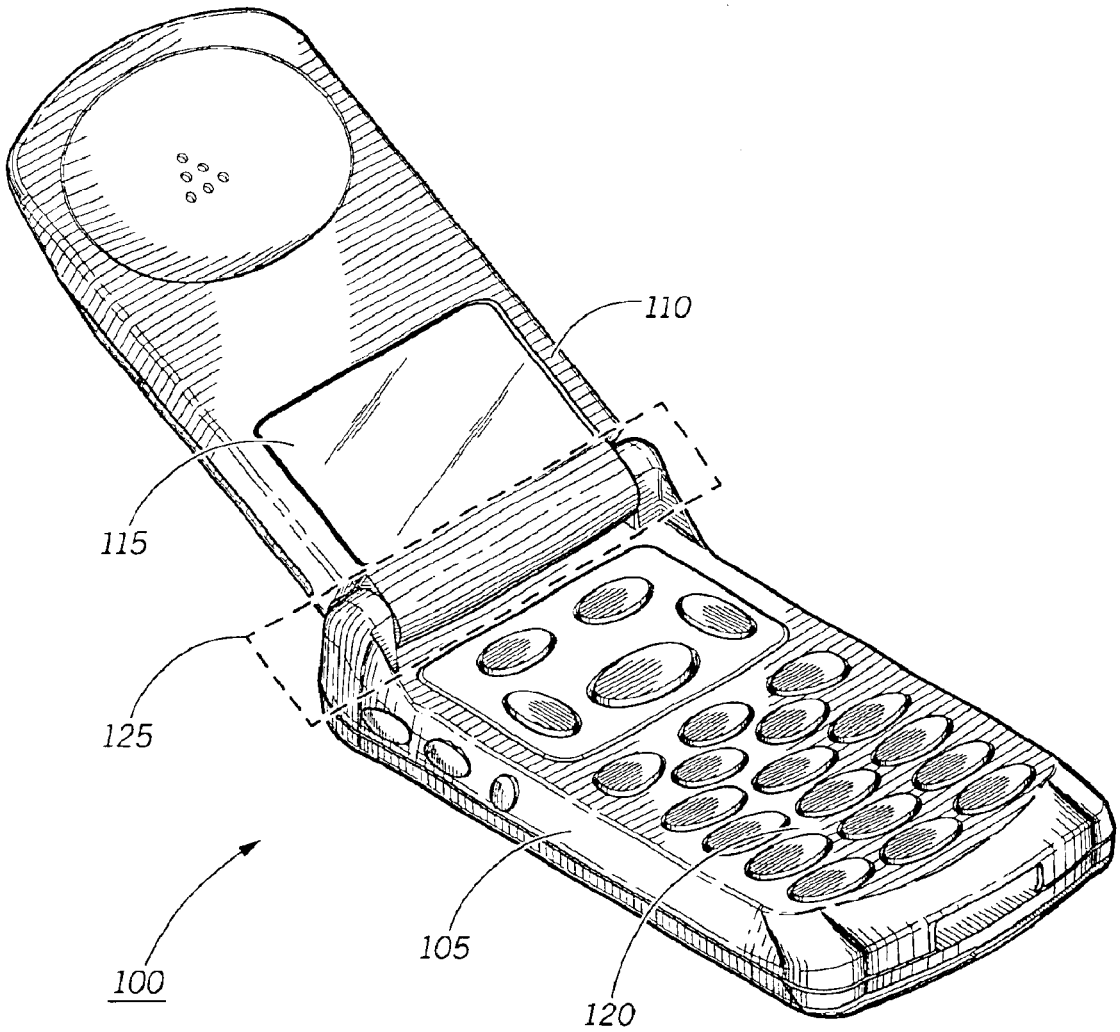
PRIOR ART FIG. 1
FIG. 1 illustrates one embodiment of a communication device.

FIG. 1 illustrates one embodiment of a communication device 100. The communication device 100, by way of example only, is embodied in a cellular radiotelephone having a conventional cellular radio transceiver circuitry, as is known in the art, and will not be presented here for simplicity. Although the invention is illustrated herein with reference to a cellular radiotelephone, the invention is alternatively applied to other communication devices such as, for example, messaging devices, personal digital assistants and personal computers with communication capability, mobile radio handsets, cordless radiotelephone and the like.

The cellular telephone includes conventional cellular telephone hardware (also not represented for simplicity) such as user interfaces that are integrated in a compact housing, and further includes an antenna system, in accordance with the present invention. Each particular communication device will offer opportunities for implementing the present invention.

As illustrated in FIG. 1, the communication device 100 includes a main housing 105 and a movable flip housing 110, although these distinctions can be reversed without affecting the invention. The movable flip housing 110 has an open position (as shown) being hinged away from the main housing 105 and a closed position (not shown) being in proximity to the main housing 105. The communication device 100 can include a user interface such as one or more of a display 115, a microphone (not shown), a keypad 120, and a speaker (not shown) as are known in the art. A hinge assembly 125 mechanically connects the main housing 105 and the movable flip housing 110. The movable flip housing 110 preferably is moveably coupled to the main housing 105 through the hinge assembly 125. The hinge assembly 125, for example, can include a hinge shaft, a first knuckle coupled to one side of the hinge shaft, and a second knuckle coupled to an opposing side of the hinge shaft. Each knuckle is a mechanical element which acts as a point of pivot and attachment between two other members.

The communication device 100 includes an antenna system (not shown) for intercepting transmitted signals from one or more communication systems in which the communication device 100 operates and for transmitting signals to the one or more communication systems. The antenna system can be located internally or externally to the main housing 105 and/or to the movable flip housing 110. In practice, the antenna system is coupled and matched to the electronic circuitry of the communication device 100 as is known in the art. Also, it will be appreciated by those of ordinary skill in the art that a signal source referred to in this specification can include a communication receiver, a communication transmitter and/or both.

Figure 2:
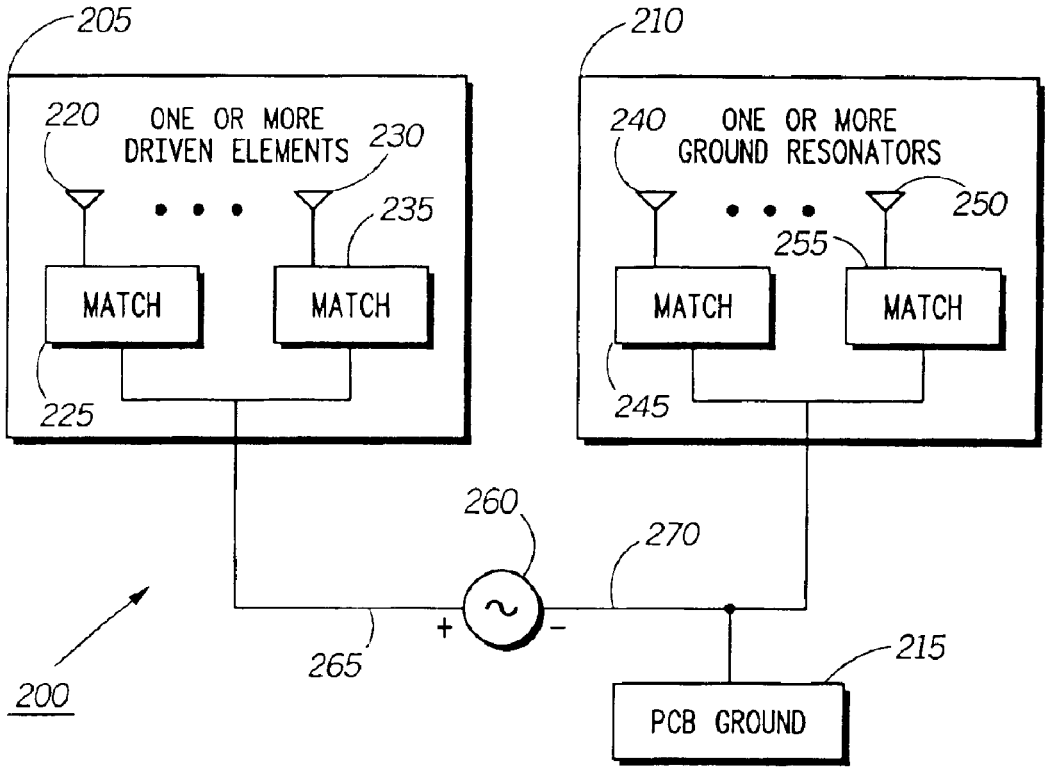
FIG. 2 is a schematic diagram of an antenna system for use within the communication device of FIG. 1.

FIG. 2 is a schematic diagram illustrating an antenna system 200 for use within the communication device of FIG. 1. The antenna system 200, as illustrated, comprises one or more driven elements 205 and one or more ground resonators 210. The one or more driven elements 205 preferably include at least one antenna coupled through an impedance match to a positive side 265 of a signal source 260. For example, as shown in FIG. 2 a first antenna 220 is coupled through a first antenna impedance match 225 to the positive side 265 of the signal source 260. Similarly, as shown in FIG. 2, a second antenna 230 is coupled through a second antenna impedance match 235 to the positive side 265 of the signal source 260. The one or more ground resonators 210 preferably include at least one antenna coupled through an impedance match to a negative side 270 of the signal source 260 which is also coupled to a PCB ground 215. For example, as shown in FIG. 2, a third antenna 240 is coupled through a third antenna impedance match 245 to the negative side 270 of the signal source 260. Similarly, as shown in FIG. 2, a fourth antenna 250 is coupled to the negative side 270 of the signal source 260 through a fourth antenna impedance match 255.

It will be appreciated by those of ordinary skill in the art that the signal source 260 can be located on a PCB of the communication device 100 either within the main housing 105 or the movable flip housing 110 or both. Similarly, each of the impedance matching networks such as the first antenna impedance match, the second antenna impedance match, the third antenna impedance match, and the fourth antenna impedance match, can be located on a PCB of the communication device 100 either within the main housing 105 or the movable flip housing 110 or both.

It will be further appreciated by one of ordinary skill in the art that each of the one or more driven elements 205 and each of the one or more ground resonators 210 can be located either at a top side of the PCB or alternatively at a bottom side of the PCB in accordance with the present invention. Further, and in accordance with the present invention, each of the one or more driven elements 205 and each of the one or more ground resonators 210 can have dual functions. The dual functions, for example, can be that functioning as an antenna radiating element and/or as functional mechanical hardware such as hinge knuckles of the hinge assembly 125 and/or components.

Further, it will be appreciated by those of ordinary skill in the art that the main operating antenna of the communication device can be one of the one or more driven elements 205 or alternatively can be one of the one or more ground resonators 210. The main antenna system element can be of a type that protrudes from the communication device 100 such as an external stubby antenna or alternatively can be an internal antenna such as a PIFA antenna. The main antennas and the other antenna elements can be separated by distances that correspond to fractions of a wavelength that provide the coupling factors needed for enhanced efficiency.

FIG. 3 is a table illustrating examples of the various alternative combinations of antennas for use in accordance with the present invention. Specifically, FIG. 3 illustrates various combinations of functionality when the antenna system 200 comprises various numbers and configurations of antennas. The table of FIG. 3 illustrates various scenarios of electrical connections for each of four antennas. A "+" sign associated with an antenna indicates the antenna is connected to the positive side of the signal source (i.e. is a driven element) whereas a "−" sign associated with an antenna indicates the antenna is connected to the negative side of the signal source (i.e. is a ground resonator). It will be appreciated by those of ordinary skill in the art that although four antennas are shown in the table of FIG. 3, any quantity of antennas can be utilized in accordance with the present invention.

Figure 4:
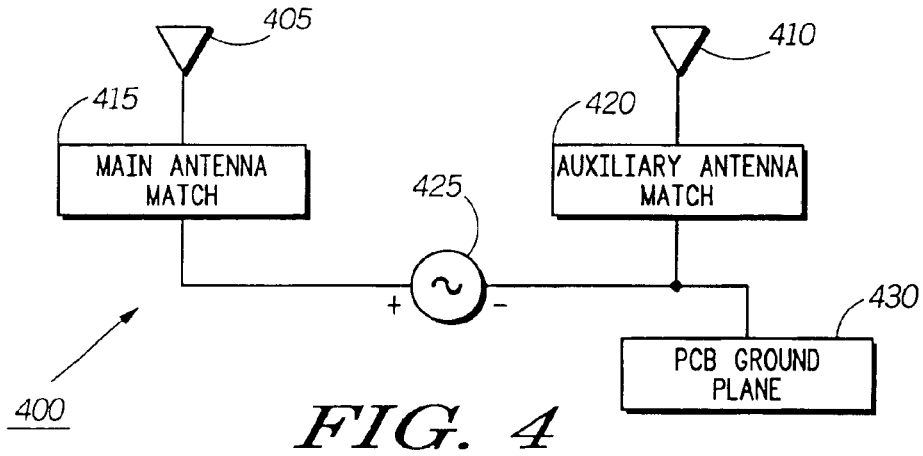
FIGS. 4 through 7 are schematic diagrams of various embodiments of the antenna system of FIG. 2 for use within the communication device of FIG. 1.

FIG. 4 is a schematic diagram of one example of an antenna system 400 for use within the communication device 100 of FIG. 1 in accordance with the present invention. Specifically, FIG. 4 illustrates the use of one driven element and one grounded resonator. As illustrated, the antenna system 400 preferably includes a main antenna 405 and an auxiliary antenna 410. A main antenna match 415 coupled to the main antenna 405 includes impedance matching elements to match the main antenna 405 to the positive side of a generator 425. An auxiliary antenna match 420 coupled to the auxiliary antenna 410 includes impedance matching elements to match the auxiliary antenna 410 to the negative side of the generator 425 which is also preferably coupled to a printed circuit board (PCB) ground plane 430.

The auxiliary antenna 410, for example, can also be used for one or more secondary communication such as Bluetooth, GPS (Global Positioning System), WLAN (wireless local area network), UMTS (universal mobile telecommunications system), and other similar communication applications. In this case where the auxiliary antenna 410 is used for one or more secondary communication, it can be driven by the signal source (not shown) of the respective secondary communication.

Figure 5:
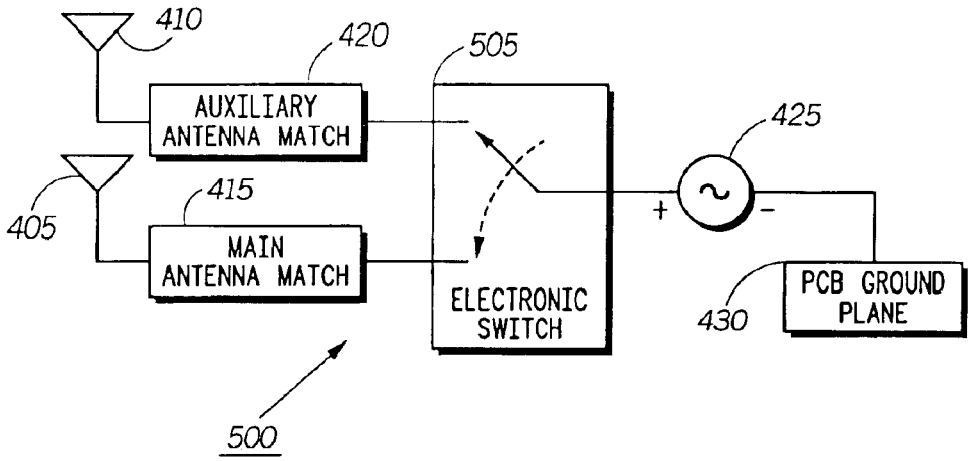

FIG. 5 illustrates an alternative embodiment to the antenna system described previously herein for FIG. 4. Specifically, FIG. 5 illustrates an antenna system 500 with the utilization of an electronic switch 505 to selectively choose between the main antenna 405 and the auxiliary antenna 410 based on the received signal strength on either or both antennas.

Figure 6:
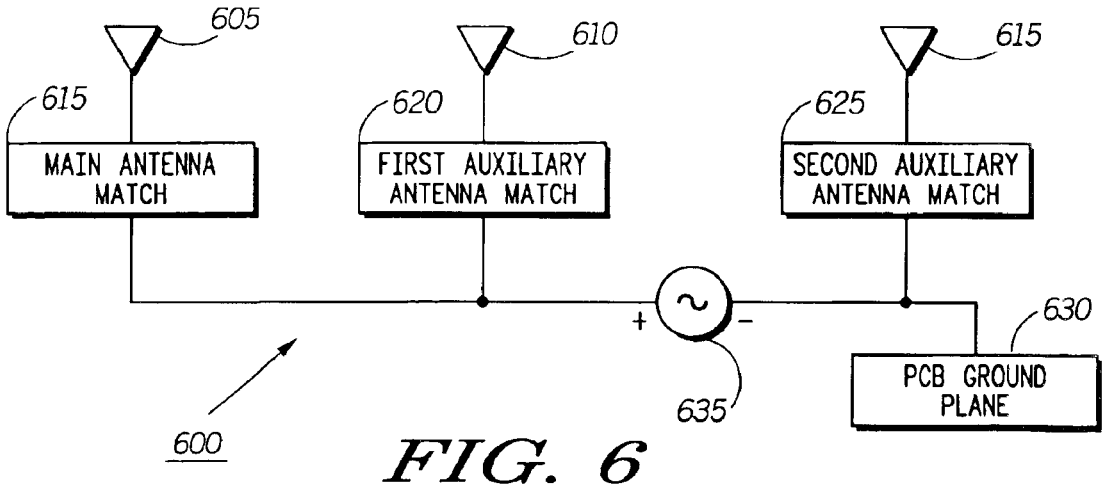

FIG. 6 is a schematic diagram of an alternate embodiment of an antenna system 600 for use within the communication device 100 of FIG. 1 in accordance with the present invention. Specifically, FIG. 6 illustrates the use of two driven elements and one grounded resonator. As illustrated, the antenna system 600 in this embodiment includes one driven element functioning as a main antenna 605 (for example, a stubby antenna) and one driven element functioning as a first auxiliary antenna 610 (for example, a hinge knuckle). A main antenna match 615 coupled to the main antenna 605 includes impedance matching elements to match the main antenna 605 to the positive side of a generator 635. A first auxiliary antenna match 620 coupled to the first auxiliary antenna 610 includes impedance matching elements to match the first auxiliary antenna 610 to the positive side of the generator 635. A grounded resonator comprises a second auxiliary antenna 615. A second auxiliary antenna match 625 coupled to the second auxiliary antenna 615 includes impedance matching elements to match the second auxiliary antenna 615 to the negative side of the generator 635 which is also preferably coupled to the printed circuit board (PCB) ground plane 630. In other words, the main antenna 605 and the first auxiliary antenna 610 are excited by the positive side of a signal source such as the generator 635 while the second auxiliary antenna 615 is excited by the negative side of a signal source such as the generator 635. In one example, the first auxiliary antenna 610 and the second auxiliary antenna 615 can be used for one or more secondary communication such as Bluetooth, GPS (Global Positioning System), WLAN (wireless local area network), UMTS (universal mobile telecommunications system), and other similar communication applications while the main antenna 605 is utilized for wide area radio frequency communications.

Figure 7:
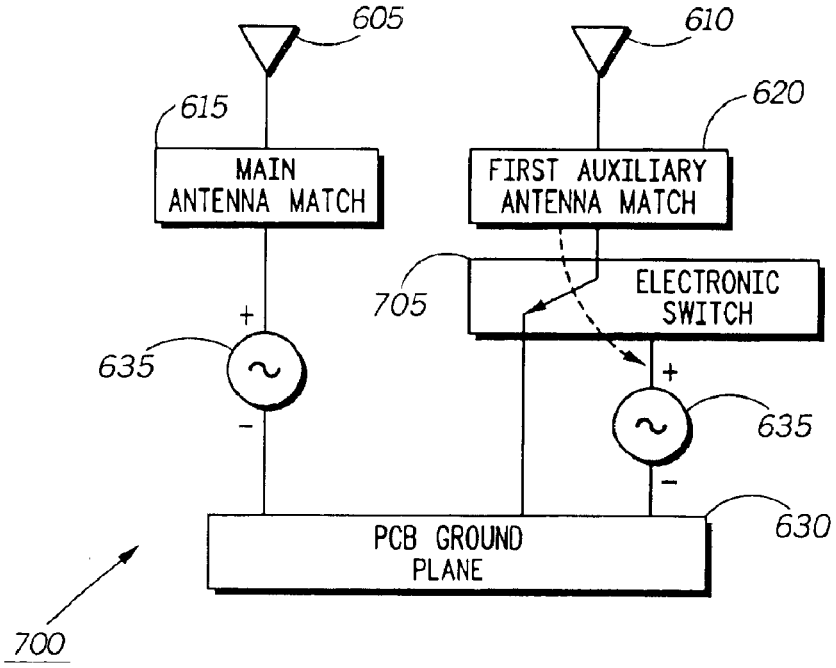

FIG. 7 illustrates an alternative embodiment to the antenna system described previously herein for FIG. 6. Specifically, FIG. 7 illustrates an antenna system 700 with the utilization of an electronic switch 705 to selectively choose between the main antenna 605 and the first auxiliary antenna 610 based on the received signal strength on either or both antennas.

By using two or more antennas in the same communication device, the antenna systems as illustrated and described herein provide a diversity antenna system with overall improved communication performance. The customer is therefore less likely to notice static or weak signals due to obstructions. The multiple antennas provide redundancy for the receipt of a clear signal. The idea of antenna diversity is that if one antenna is experiencing a low signal level due to fading, also called a deep fade, the other antenna(s) may not experience the same deep fade, provided the antennas are displaced in position or in polarity. This option to select the best antenna can significantly improve performance particularly in indoor environments. This approach can also provide an efficient antenna performance into smaller communication devices while achieving acceptable quad-band performance at various frequencies such as 800, 900, 1800, and 1900 MHz (MegaHertz).

Figure 8:
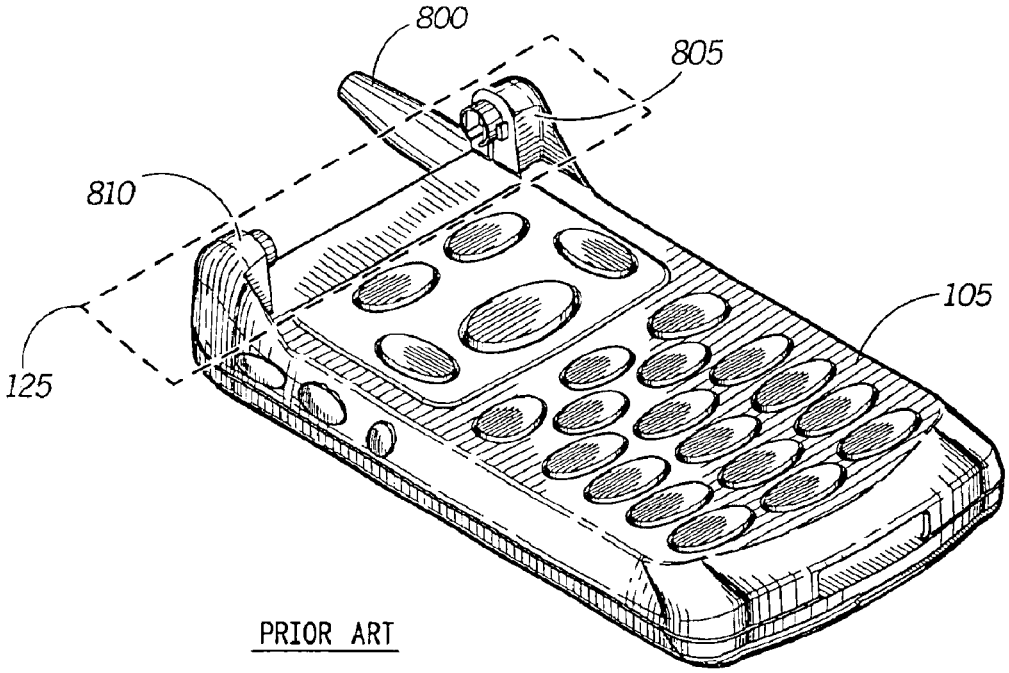
FIG. 8 illustrates one portion of the communication device of FIG. 1.

FIG. 8 illustrates one portion of the communication device 100. As illustrated in FIG. 8, the main antenna of the antenna systems can be a stubby antenna 800 connected to the main housing 105 of the communication device 100. Alternatively, the main antenna can be connected to the movable flip housing 110 (not shown). Further, the hinge assembly 125 can include a first metal knuckle 805 and a second metal knuckle 810 mechanically coupled to the main housing 105 (as shown) and/or the movable flip housing 110. The first metal knuckle 805 and the second metal knuckle 810 can be composed of chrome plated zinc or an equivalent combination of materials. In accordance with the present invention, one of the one or more driven elements 205 of the antenna system 200 can comprise the first metal knuckle 805 and/or the second metal knuckle 810. Similarly, one of the one or more ground resonators 210 can comprise the first metal knuckle 805 and/or the second metal knuckle 810.

As one example of the present invention, the antenna system 400 of FIG. 4 can comprise the first metal knuckle 805 as the main antenna 405 and the second metal knuckle 810 as the auxiliary antenna 410 and the stubby antenna 800 can be eliminated. As another example of the present invention, the antenna system 400 of FIG. 4 can comprise the stubby antenna 800 as the main antenna 405 and either or both of the first metal knuckle 805 and the second metal knuckle 810 as the auxiliary antenna 410.

As another example, the antenna system 600 can comprise the stubby antenna 800 as the main antenna 605 and the first metal knuckle 805 as the first auxiliary antenna 610 which are excited by the positive-side signal source (generator 635); and the second metal knuckle 810 as the second auxiliary antenna 615 which is excited by the negative side of the signal source (generator 635).

Using one or more of the knuckles for the auxiliary antenna and/or the main antenna provides better overall antenna system bandwidth. Other benefits include reduced degradation in efficiency due to the proximity of a human head and/or hand, which can cause antenna detuning.

In accordance with an alternative embodiment of the present invention, the metal knuckles described previously for FIG. 8 can be replaced with one or more metallic sheets. Utilizing different configurations of metallic sheets instead of metallic knuckles allows the implementation of the antenna system of the present invention in various communication device form factors such as those that cannot afford the volume occupied by solid metallic knuckles. However, for clarity purposes, the invention will be described in terms of the knuckle structure.

Figure 9:
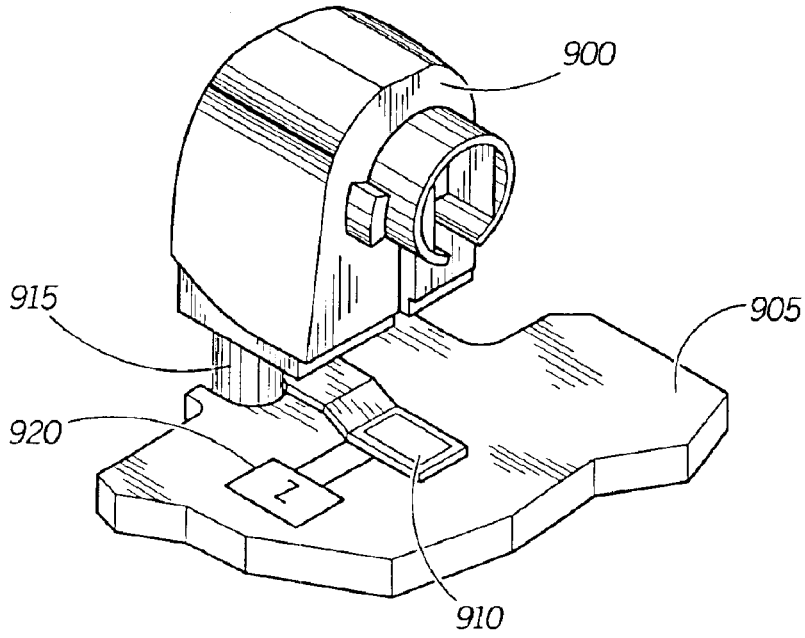
FIGS. 9 and 10 illustrate more detail of the portion of the communication device illustrated in FIG. 8.

FIG. 9 illustrates one embodiment of electrically connecting the first metal knuckle 805 and the second metal knuckle 810 to the printed circuit board for making the required electrical connections for the antenna system. As illustrated, a knuckle 900 can be electrically and mechanically coupled to a printed circuit board 905 using a spring contact 910 connected to at least one portion 915 of the knuckle 900. The spring contact 910, for example, can be a gold plated conductive spring clip which is reflow-soldered to the printed circuit board 905. Alternatively (not shown), the knuckle 900 can contact directly to a conductive pad printed on the printed circuit board 905. The knuckle 900, for example, can be the first metal knuckle 805 and/or the second metal knuckle 810. In one embodiment, one or more impedances 920 is connected between the spring contact 910 and the printed circuit board 905 to provide an optimum impedance match for enhanced antenna efficiency. The optimum value of the impedance 920 is partially determined by the distance between the printed circuit board 905 and the knuckle 900.

To enhance the antenna system performance, the ground under the knuckle can be removed or be used as part of the resonator structure by detaching it from main transceiver ground. The impedance 920 preferably connects one end of the knuckle to the transceiver ground. Further, a small gap can be provided between the transceiver ground and the resonator structure preferably on the PCB 905 to form a distributed capacitor in order to resonate with the impedance 920. Alternatively, all of the ground can be removed while increasing the value of the impedance 920. Test results indicate that placing the impedance 920 close to the edges of the PCB 905 ground enhances performance.

Preferably other-electronic components are located outside the environment of the resonator. Further, the ground components located near the resonator preferably is choked. Flex cables used within the communication device 100 preferably are routed to the moveable flip housing 110 from the side that the impedance 920 is located since that side has lower strength of E-field (electromagnetic field) and coupling between them results in minimum detuning to the resonator. The other end of the knuckle 900 will be floating with as much distance that can be provided on the PCB 905 due to the presence of high E-fields and possibility of detuning of resonator.

Figure 10:
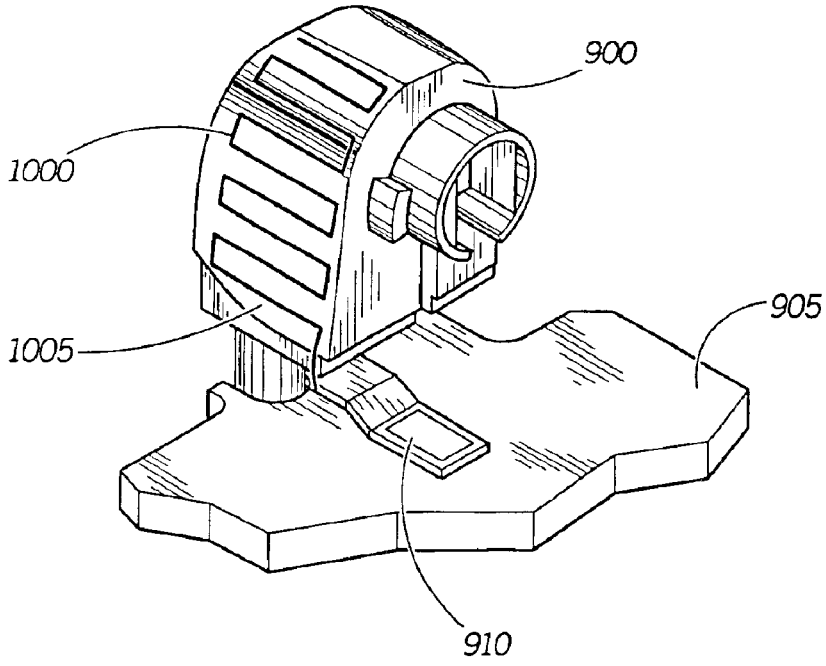

The knuckle 900 can be made of metallic materials such as chrome-plated zinc. Alternatively, the knuckle 900 can be made of non-metallic materials and have a conductive antenna pattern attached internally or externally to it. FIG. 10 illustrates one example in which a conductive meander pattern 1000 is deposited/printed on the inside of a knuckle surface 1005 of the knuckle 900, using techniques that are well known in the art. The meander pattern can also be printed on a mylar backing flex and inserted inside the knuckle which in this case will be made of a non-conductive material. It will be appreciated by those of ordinary skill in the art that multiple meander patterns can be used to facilitate multi-band operation. For example, each of the multiple meander patterns can have different connections to the printed circuit board 905 for switching bands of operation or solely for use on alternative communication channels such as Bluetooth, GPS, etc. The conductive meander pattern 1000 can be connected to the printed circuit board 905 by means of the spring contact 910 as illustrated in FIG. 9 or directly connected by contacting a conductive pad on the surface of the printed circuit board 905.

An additional-benefit to the antenna system construction as described herein is the reduction in electrostatic discharge issues. The electrically connected knuckles provide a path for the electricity thereby minimizing the electricity path to nearby electrical circuitry and components of the communication device 100 connected on the printed circuit board 905 and/or nearby flex circuits such as a side button flex.

Figure 11:
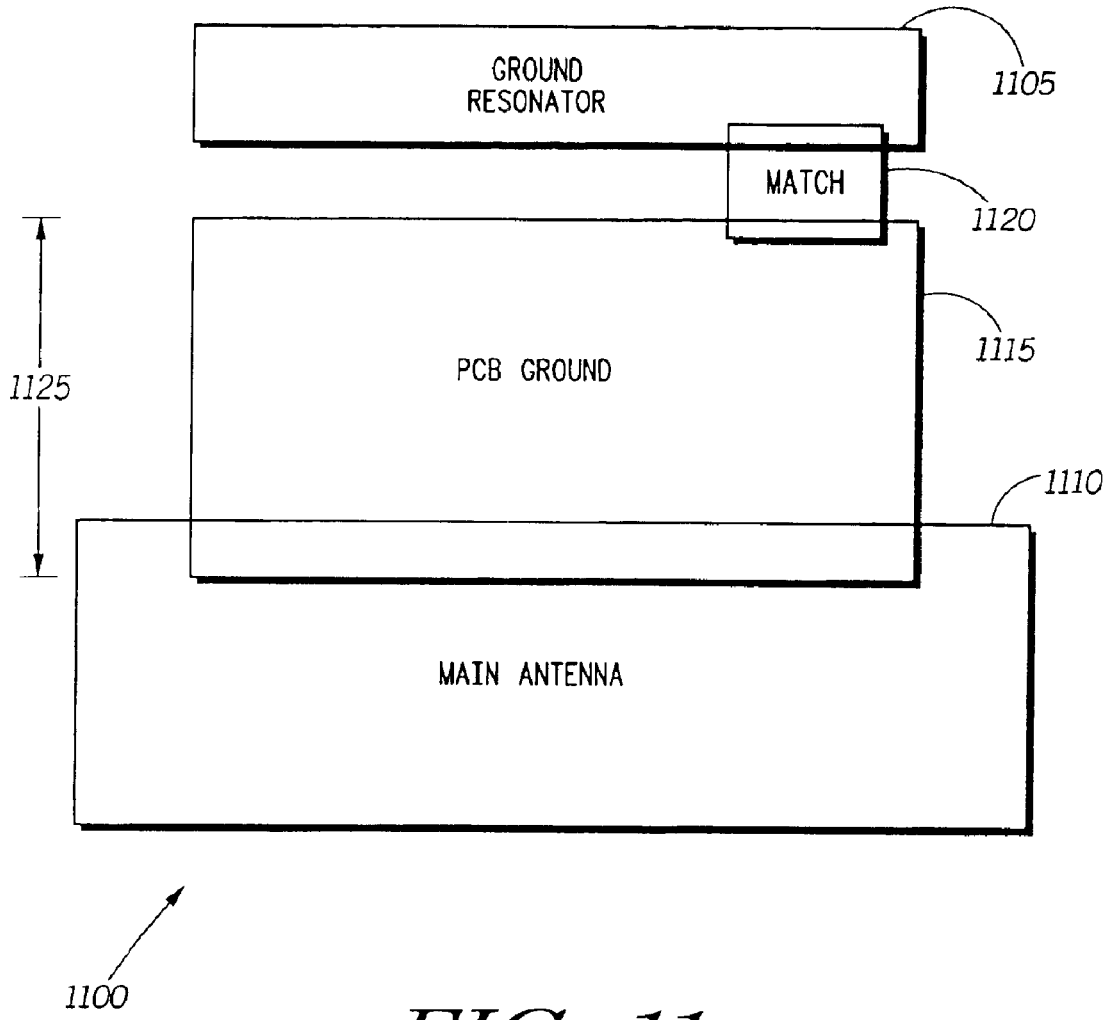
FIG. 11 illustrates an alternative embodiment of the antenna system of FIG. 2 within the communication device of FIG. 1.

FIG. 11 illustrates one physical embodiment of the antenna system of the present invention within the communication device 100. Specifically, as illustrated in FIG. 11, an antenna system 1100 includes a ground resonator 1105 and a main antenna 1110 located at opposing ends and/or sides of a PCB ground 1115. An impedance match 1120 coupled between the ground resonator 1105 and the PCB ground 1115 provides required matching of these elements. It will be appreciated by those of ordinary skill in the art that the ground resonator 1105 can be constructed using one or more metal knuckles or one or more metallic sheets as described previously herein for FIGS. 8 through 10.

To implement the present invention, the bandwidth of the antenna system 1100 can be determined by the coupling factor of the two resonators (i.e. the main antenna 1110 and the ground resonator 1105 of the antenna system 1100), as a function of their separation by the PCB ground 1115. The length of the PCB ground 1115 provides the required phase length and/or coefficient of coupling between the resonating elements resonators (i.e. the main antenna 1110 and the ground resonator 1105 of the antenna system 1100) and also, is a radiating element in the antenna system 1100. It will be appreciated by those of ordinary skill in the art that the resonating-elements coupled with the optimum coupling coefficient can have a wider bandwidth than with a single element structure.

Since the PCB, additional ground resonator and/or hinge knuckles, and the impedance match all can adjust the phase of the overall ground structure (1115, 1120, 1105), they are interchangeable, meaning that if a different PCB length and ground resonator length is desired, one can change the impedance value to achieve the increased bandwidth.

In summary, the antenna system described herein provides enhanced performance in a communication device by utilizing existing mechanical structures as integral components in the antenna system. Specifically, the antenna system described herein provides enhanced performance for flip-type communication devices by using the knuckles of the hinge assembly as integral parts of the antenna system.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A communication device for use within one or more communication systems, the communication device comprising:

a main housing;

a movable flip housing moveably coupled to the main housing through a hinge assembly;

the hinge assembly coupled between the main housing and the movable flip housing, the hinge assembly comprising:

a hinge shaft, a first knuckle coupled to one side of the hinge shaft, and a second knuckle coupled to an opposing side of the hinge shaft; and an antenna system for transmitting and receiving communication signals within the one or more communication systems, the antenna system comprising:

the first knuckle coupled to a positive side of a signal source.

2. A communication device as recited in claim 1, wherein the first knuckle is coupled through a first impedance match to the positive side of the signal source.

3. A communication device as recited in claim 1, further comprising:

a printed circuit board, wherein the signal source is coupled to the printed circuit board, and further wherein the first knuckle is coupled to the positive side of the signal source through a conductive spring clip coupled to the printed circuit board.

4. A communication device as recited in claim 1, wherein the antenna system further comprises:

the second knuckle coupled to a negative side of the signal source.

5. A communication device as recited in claim 4, wherein the first knuckle is used for communication within a first communication system, and wherein the second knuckle is used for communication within a second communication system.

6. A communication device as recited in claim 4, wherein the second knuckle is coupled through a second impedance match to the negative side of the signal source.

7. A communication device as recited in claim 4 further comprising:

a printed circuit board having a printed circuit board ground, wherein the negative side of the signal source is coupled to the printed circuit board ground and further wherein the second knuckle is coupled to the printed circuit board ground.

8. A communication device as recited in claim 7 wherein the second knuckle is coupled to the printed circuit board ground through a conductive spring clip.

9. A communication device as recited in claim 1, wherein the antenna system further comprises:

a main antenna coupled to the positive side of the signal source.

10. A communication device as recited in claim 9, wherein the main antenna is used for communication within a first communication system, and wherein the first knuckle is used for communication within a second communication system.

11. A communication device as recited in claim 9, wherein the main antenna is coupled through a main antenna impedance match to the positive side of the signal source.

12. A communication device as recited in claim 9, wherein the antenna system further comprises an electronic switch, and further wherein the main antenna and the first knuckle are coupled to the positive side of the signal source through the electronic switch.

13. A communication device as recited in claim 9, wherein the antenna system further comprises:

the second knuckle coupled to a negative side of the signal source.

14. A communication device as recited in claim 13, further comprising:

a printed circuit board having a printed circuit board ground, wherein the negative side of the signal source is coupled to the printed circuit board ground and further wherein the second knuckle is coupled to the printed circuit board ground.

15. A communication device as recited in claim 14, wherein the second knuckle is coupled to the printed circuit board ground through a conductive spring clip.

16. A communication device for use within one or more communication systems, the communication device comprising:

a main housing;

a movable flip housing moveably coupled to the main housing through a hinge assembly;

the hinge assembly coupled between the main housing and the movable flip housing, the hinge assembly comprising:

a hinge shaft, a first knuckle coupled to one side of the hinge shaft, and a second knuckle coupled to an opposing side of the hinge shaft; and an antenna system for transmitting and receiving communication signals within the one or more communication systems, the antenna system comprising:

the first knuckle coupled to a negative side of a signal source, and a main antenna coupled to a positive side of the signal source.

17. A communication device as recited in claim 16, wherein the antenna system further comprises:

the second knuckle coupled to the negative side of the signal source.

18. A communication device as recited in claim 17 further comprising:

a printed circuit board having a printed circuit board ground, wherein the negative side of the signal source is coupled to the printed circuit board ground and further wherein the second knuckle is coupled to the printed circuit board ground.

19. A communication device as recited in claim 18 wherein the second knuckle is coupled circuit board ground through a conductive spring clip.

20. An antenna system for use within a communication device, the communication device including a signal source, a main housing and a movable flip housing moveably coupled to the main housing through a hinge assembly, the hinge assembly being comprised of a hinge shaft, a first knuckle coupled to one side of the hinge shaft, and a second knuckle coupled to an opposing side of the hinge shaft, the antenna system comprising:

the first knuckle coupled to a positive side of the signal source.

21. An antenna system as recited in claim 20, wherein the first knuckle is coupled through a first impedance match to the positive side of the signal source.

22. An antenna system as recited in claim 20, wherein the first knuckle includes an attached conductive antenna pattern.

23. An antenna system as recited in claim 20 further comprising:

the second knuckle coupled to a negative side of the signal source.

24. An antenna system as recited in claim 23 wherein the communication device further includes a printed circuit board having a printed circuit board ground, wherein the negative side of the signal source is coupled to the printed circuit board ground and further wherein the second knuckle is coupled to the printed circuit board ground.

25. An antenna system as recited in claim 24 wherein the second knuckle is coupled to the printed circuit board ground through a conductive spring clip.

26. An antenna system as recited in claim 23, wherein the second knuckle is coupled through a second impedance match to the negative side of the signal source.

27. An antenna system as recited in claim 23, wherein the second knuckle includes an attached conductive antenna pattern.

28. An antenna system as recited in claim 20 further comprising:

a main antenna coupled to the positive side of the signal source.

29. An antenna system as recited in claim 28 wherein the main antenna is coupled through a main antenna impedance match to the positive side of the signal source.

30. An antenna system as recited in claim 28 further comprising an electronic switch, and further wherein the main antenna and the first knuckle are coupled to the positive side of the signal source through the electronic switch.

31. An antenna system as recited in claim 28 further comprising:

the second knuckle coupled to a negative side of the signal source.

32. An antenna system for a communication device, the communication device including a signal source, a main housing and a movable flip housing moveably coupled to the main housing through a hinge assembly, the hinge assembly being comprised of a hinge shaft, a first knuckle coupled to one side of the hinge shaft, and a second knuckle coupled to an opposing side of the hinge shaft, the antenna system comprising:

the first knuckle coupled to a negative side of the signal source, and a main antenna coupled to a positive side of the signal source.

33. An antenna system as recited in claim 32 further comprising:

the second knuckle coupled to the negative side of the signal source.

34. An antenna system as recited in claim 33 wherein the main antenna is used for communication within a first communication system, and wherein the first knuckle and the second knuckle are used for communication within a second communication system.

35. An antenna system as recited in claim 33, wherein the communication device further includes a printed circuit board having a printed circuit board ground, wherein the negative side of the signal source is coupled to the printed circuit board ground, and further wherein the second knuckle is coupled to the printed circuit board ground.

36. An antenna system as recited in claim 35 wherein the second knuckle is coupled to the printed circuit board ground through a conductive spring clip.

* * * * *